US010930113B2

(12) United States Patent
Itkis et al.

(10) Patent No.: US 10,930,113 B2
(45) Date of Patent: Feb. 23, 2021

(54) SLOT MACHINE CABINET WITH HORIZONTALLY-MOUNTED BILL VALIDATOR

(71) Applicants: Yuri Itkis, Las Vegas, NV (US); Horia M. Preda, Las Vegas, NV (US)

(72) Inventors: Yuri Itkis, Las Vegas, NV (US); Horia M. Preda, Las Vegas, NV (US)

( * ) Notice: Subject to any disclaimer, the term of this patent is extended or adjusted under 35 U.S.C. 154(b) by 30 days.

(21) Appl. No.: 16/505,457

(22) Filed: Jul. 8, 2019

(65) Prior Publication Data

US 2019/0333324 A1 Oct. 31, 2019

Related U.S. Application Data

(63) Continuation of application No. 15/335,359, filed on Oct. 26, 2016, now abandoned, which is a continuation-in-part of application No. 14/191,406, filed on Feb. 26, 2014, now abandoned.

(51) Int. Cl.
*G07F 17/00* (2006.01)
*G07F 17/32* (2006.01)

(52) U.S. Cl.
CPC ..... *G07F 17/3241* (2013.01); *G07F 17/3223* (2013.01)

(58) Field of Classification Search
None
See application file for complete search history.

(56) References Cited

U.S. PATENT DOCUMENTS 4,440,457 A * 4/1984 Fogelman ..... A63F 13/08 463/46
4,455,025 A * 6/1984 Itkis ..... A63F 3/00643 273/237
5,515,959 A * 5/1996 Stephenson, III .... E05D 7/1066 16/267
5,676,231 A * 10/1997 Legras ..... G07F 17/3216 194/206
6,699,128 B1 * 3/2004 Beadell ..... G07F 17/32 292/106
6,997,810 B2 * 2/2006 Cole ..... G07F 17/32 463/36
7,137,883 B1 * 11/2006 Falciglia, Sr. ..... G07F 17/3244 463/13
2002/0155887 A1 * 10/2002 Criss-Puszkiewicz ..... G07F 17/323 463/29
2004/0087374 A1 * 5/2004 Cole ..... G07F 17/32 463/46
2005/0107167 A1 * 5/2005 Sasaki ..... A63F 13/08 463/46
2005/0121286 A1 * 6/2005 Iannello ..... G07F 17/3246 194/206

(Continued)

*Primary Examiner* — Paul A D'Agostino
(74) *Attorney, Agent, or Firm* — FisherBroyles, LLP; Rob L. Phillips

(57) ABSTRACT

A slot machine cabinet including a bill validator. The bill validator is mounted horizontally yielding significant leg-room for players and reducing the footprint of the slot machine cabinet. The cabinet includes a horizontal top door and a vertical front door. The top door supports on top thereof a touchscreen monitor and the front door includes a slot for inserting currency, tickets and vouchers into the bill validator. The front door may also include slots for inserting magnetic cards and dispensing receipt tickets.

5 Claims, 7 Drawing Sheets

(56) References Cited

U.S. PATENT DOCUMENTS

| | | | | |
|---|---|---|---|---|
| 2007/0155512 | A1* | 7/2007 | Wells | G07F 17/32 463/46 |
| 2007/0197301 | A1* | 8/2007 | Cole | G07F 17/3202 463/46 |
| 2008/0227554 | A1* | 9/2008 | Cole | G07F 17/3216 463/46 |
| 2009/0131134 | A1* | 5/2009 | Baerlocher | G07F 17/322 463/13 |
| 2009/0143141 | A1* | 6/2009 | Wells | G07F 17/3237 463/37 |
| 2009/0221375 | A1* | 9/2009 | Luciano, Jr. | G07F 17/32 463/46 |
| 2010/0087259 | A1* | 4/2010 | Johnson | G07F 17/3216 463/46 |
| 2013/0065686 | A1* | 3/2013 | LeMay | G07F 17/3255 463/37 |
| 2016/0184716 | A1* | 6/2016 | Sprenger | G07F 17/3216 463/46 |
| 2017/0061732 | A1* | 3/2017 | Baerlocher | G07F 17/3244 |
| 2018/0089954 | A1* | 3/2018 | Carpenter | G07F 17/3276 |
| 2019/0096169 | A1* | 3/2019 | Tovar | G07F 17/3209 |
| 2020/0202663 | A1* | 6/2020 | Halvorson | G07F 17/3272 |
| 2020/0202670 | A1* | 6/2020 | Hiten | G07F 17/3216 |

* cited by examiner

SLOT MACHINE CABINET WITH HORIZONTALLY-MOUNTED BILL VALIDATOR

CROSS-REFERENCE

This application is a continuation of, and claims priority to, U.S. patent application Ser. No. 15/335,359 filed Oct. 26, 2016 which is a continuation-in-part of, and claims priority to, U.S. patent application Ser. No. 14/191,406 filed Feb. 26, 2014 both of which are incorporated herein for any and all purposes.

FIELD OF THE INVENTION

The embodiments of the present invention relate to a slot machine cabinet having a horizontally-mounted bill validator.

BACKGROUND

Heretofore, slot machine cabinets have included a vertically-mounted bill validator. Although the conventional vertical mounting of the bill validator is familiar to the players, vertical mounting renders the slot machine cabinet bulky and increases the footprint of the cabinet and associated slot machine chair.

Accordingly, it would be advantageous to reduce the volume and footprint of slot machine cabinets while providing sufficient legroom for players. In one embodiment, the bill validator is mounted horizontally as detailed below.

SUMMARY

Slot machines include bill validators configured to accept currency, tickets and vouchers. The embodiments of the present invention involve mounting horizontally the bill validator thereby creating convenient legroom for players and reducing the cabinet's footprint. The slot cabinet includes a horizontally-oriented top door and a vertically-oriented front door. The top door supports a touchscreen monitor and the front door includes a slot for receiving currency, tickets and vouchers into the bill validator. The front door also includes receiving slots for insertion of magnetic cards and for dispensing receipt tickets.

Other variations, embodiments and features of the present invention will become evident from the following detailed description, drawings and claims.

DETAILED DESCRIPTION

Figure 1:
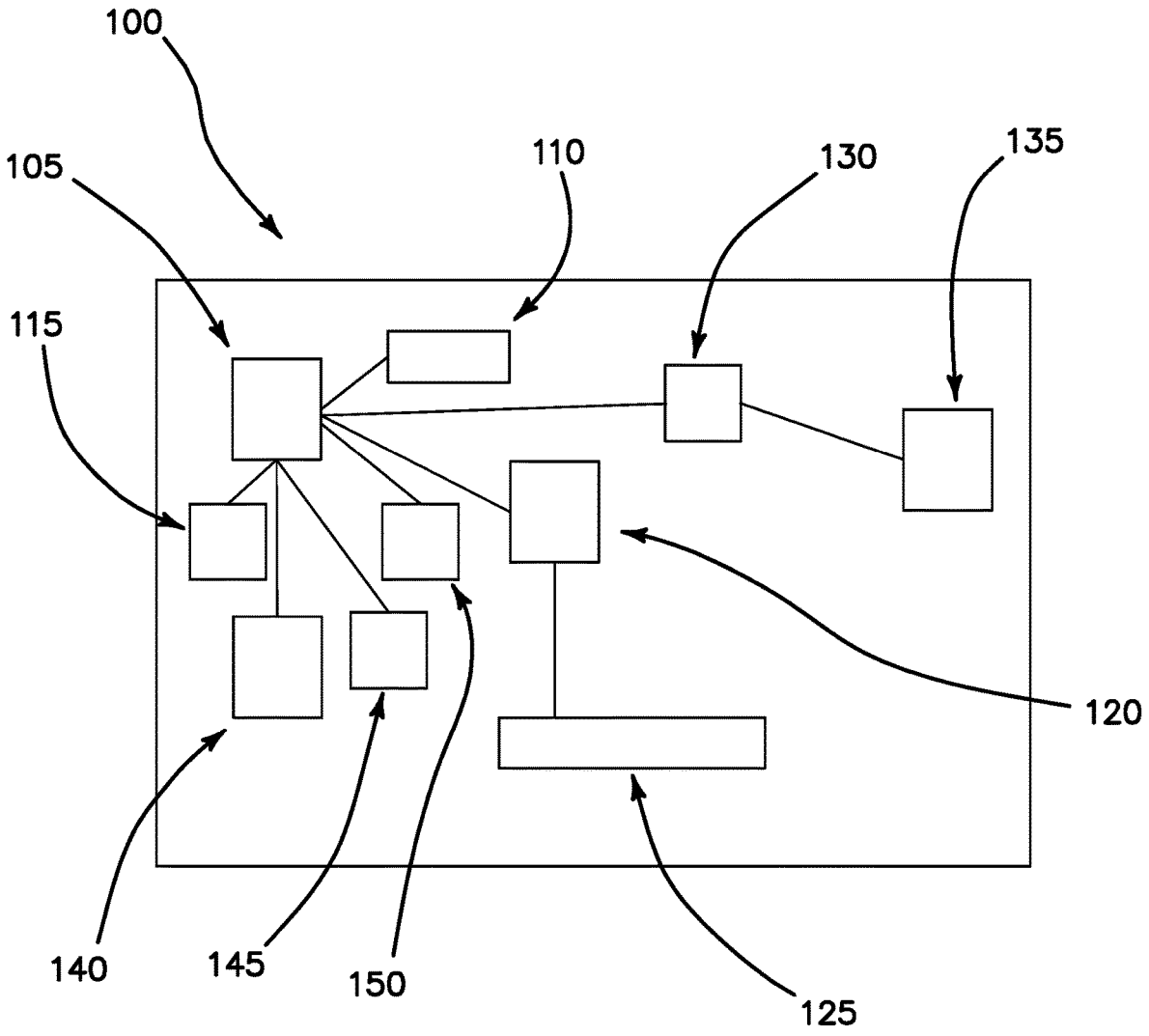
FIG. 1 illustrates a block diagram of an electronic gaming device of the type which may utilize the embodiments of the present invention.

For the purposes of promoting an understanding of the principles in accordance with the embodiments of the present invention, reference will now be made to the embodiments illustrated in the drawings and specific language will be used to describe the same. It will nevertheless be understood that no limitation of the scope of the invention is thereby intended. Any alterations and further modifications of the inventive feature illustrated herein, and any additional applications of the principles of the invention as illustrated herein, which would normally occur to one skilled in the relevant art and having possession of this disclosure, are to be considered within the scope of the invention claimed.

Those skilled in the art will recognize that the virtual, digital and online embodiments of the present invention involve both hardware and software elements which portions are described below in such detail required to construct and operate a game method and system according to the embodiments of the present invention.

As will be appreciated by one skilled in the art, aspects of the present invention may be embodied as a system, method or computer program product. Accordingly, aspects of the present invention may take the form of an entirely hardware embodiment, an entirely software embodiment (including firmware, resident software, micro-code, etc.), or an embodiment combining software and hardware. Furthermore, aspects of the present invention may take the form of a computer program product embodied in one or more computer readable medium(s) having computer readable program code embodied thereon.

Any combination of one or more computer readable medium(s) may be utilized. The computer readable medium may be a computer readable signal medium or a computer readable storage medium. A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), and optical storage device, a magnetic storage device, or any suitable combination of the foregoing. In the context of this document, a computer readable storage medium may be any tangible medium that can contain or store a program for use by or in connection with an instruction execution system, apparatus, or device.

A computer readable signal medium may include a propagated data signal with computer readable program code embodied thereon, for example, in baseband or as part of a carrier wave. Such a propagated signal may take any variety of forms, including, but not limited to, electromagnetic, optical, or any suitable combination thereof. A computer readable signal medium may be any computer readable medium that is not a computer readable storage medium and that can communicate, propagate, or transport a program for use by or in conjunction with an instruction execution system, apparatus, or device.

Program code embodied on a computer readable medium may be transmitted using any appropriate medium, including but not limited to wireless, wireline, optical fiber cable, RF and the like, or any suitable combination of the foregoing.

Computer program code for carrying out operations for aspects of the present invention may be written in any combination of one or more programming languages, including an object oriented programming language such as Java, Smalltalk, C++ or the like or conventional procedural programming languages, such as the "C" programming language, AJAX, PHP, HTML, XHTML, Ruby, CSS or similar programming languages. The programming code may be configured in an application, an operating system, as part of a system firmware, or any suitable combination thereof. The programming code may execute entirely on the user's computer, partly on the user's computer, as a standalone software package, partly on the user's computer and partly on a remote computer or entirely on a remote computer or server as in a client/server relationship sometimes known as cloud computing. In the latter scenario, the remote computer may be connected to the user's computer through any type of network, including a local area network (LAN) or a wide area network (WAN), or the connection may be made to an external computer (for example, through the Internet using an Internet Service Provider).

Aspects of the present invention are described below with reference to flowchart illustrations and/or block diagrams of methods, apparatus (systems) and computer program products according to embodiments of the invention. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram.

These computer program instructions may also be stored in a computer readable medium that can direct a computer, other programmable data processing apparatus, or other devices to function in a particular manner, such that the instructions stored in the computer readable medium produce an article of manufacture including instructions which implement the function/act specified in the flowchart and/or block diagram.

The computer program instructions may also be loaded onto a computer, other programmable data processing apparatus, or other devices to cause a series of operational steps to be performed on the computer, other programmable apparatus or other devices to produce a computer-implemented process such that the instructions which execute on the computer or other programmable apparatus provide processes for implementing the functions/acts specified in the flowchart and/or block diagrams. As used herein, a "gaming device" and "gaming machine" should be understood to be any one of a general purpose computer, as for example a personal computer or a laptop computer, a client computer configured for interaction with a server, a special purpose computer such as a server, or a smart phone, tablet computer, personal digital assistant or any other machine adapted for executing programmable instructions in accordance with the description thereof set forth herein.

A block diagram of an electronic gaming device (e.g., slot machine) 100 is shown in FIG. 1. The exemplary electronic gaming device 100 may include a central processing unit (CPU) also deemed a processor 105 which controls the electronic gaming device 100 based on instructions stored in program read-only memory (ROM) 110 and pay table ROM 115. Program ROM 110 stores executable instructions related to the operation of the gaming device 100 and which are generally permanent. CPU 105 may be connected to a video controller 120 which provides output to one or more video displays 125. Similarly, an audio controller 130 provides audio output as dictated by the CPU 105 through speakers 135. The aforementioned components, and others, may be attached to a circuit board forming a motherboard. In another embodiment, the electronic gaming device 100 may be linked to a central game server which allows players to select from a number of games via the electronic gaming device 100. In such an embodiment, one or more processors integrated into the central server control the gaming device 100 based on instructions stored in program ROM 110.

A user interface 140 may respond to buttons on button panel or display incorporating touch screen technology or any other devices providing means for users to communicate with, and instruct, the electronic gaming device 100. Wager memory 145 stores an amount of money/credits deposited into the electronic gaming device 100 by a player and specific wager information related to each play of the electronic gaming device 100. Payout system 150 includes a coupon printer or similar device for receiving money/coupon from the electronic gaming device 100.

Those skilled in the art will recognize that the configuration and features of the electronic gaming device 100 disclosed herein are exemplary and may be altered in any number of ways without impacting the embodiments of the present invention.

Figure 2:
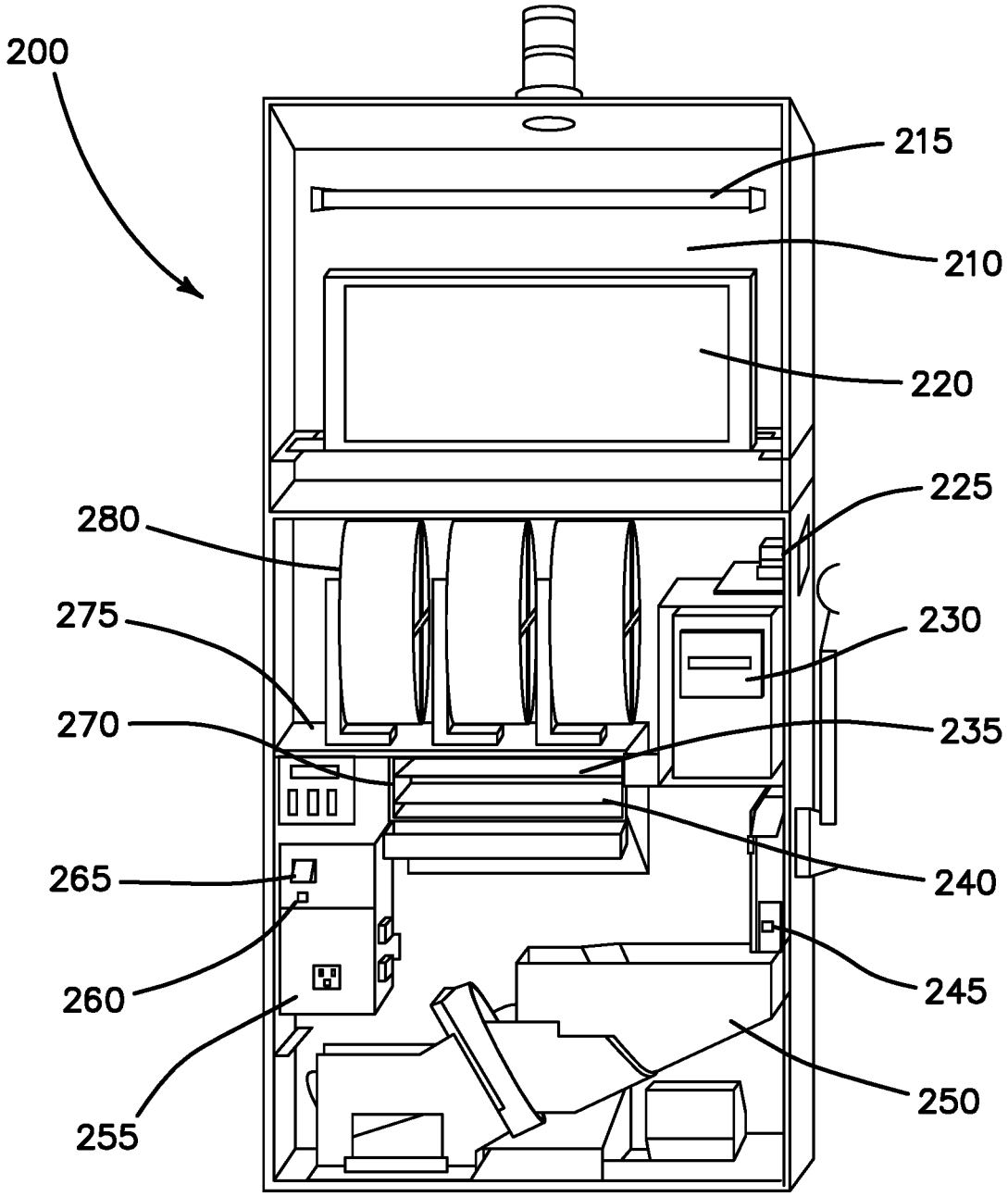
FIG. 2 illustrates an exemplary, prior art slot machine cabinet and internal components.

FIG. 2 shows the interior of an exemplary, prior art slot machine cabinet 200. As shown, a slot machine cabinet 205 contains a top box 210, top box lamp 215, display 220, meters 225, bill validator 230, I/O board 235, CPU board 240, front door switch 245, hopper 250, PDU 255, fuse 260, on/off switch 265, card cage 270, chassis 275 and reels 280.

Figure 3:
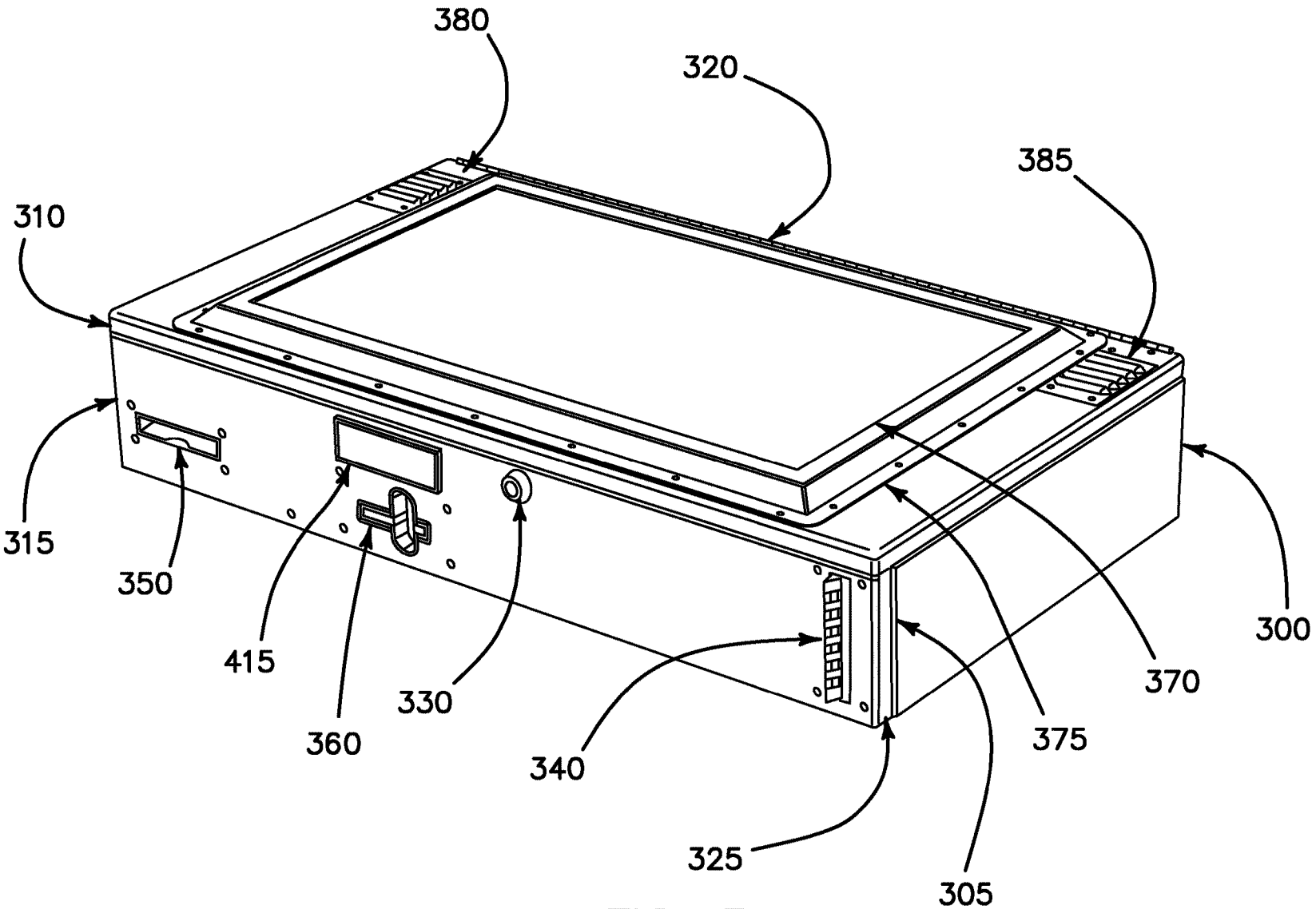
FIG. 3 illustrates a view of a slot machine cabinet according to the embodiments of the present invention.
Figure 4:
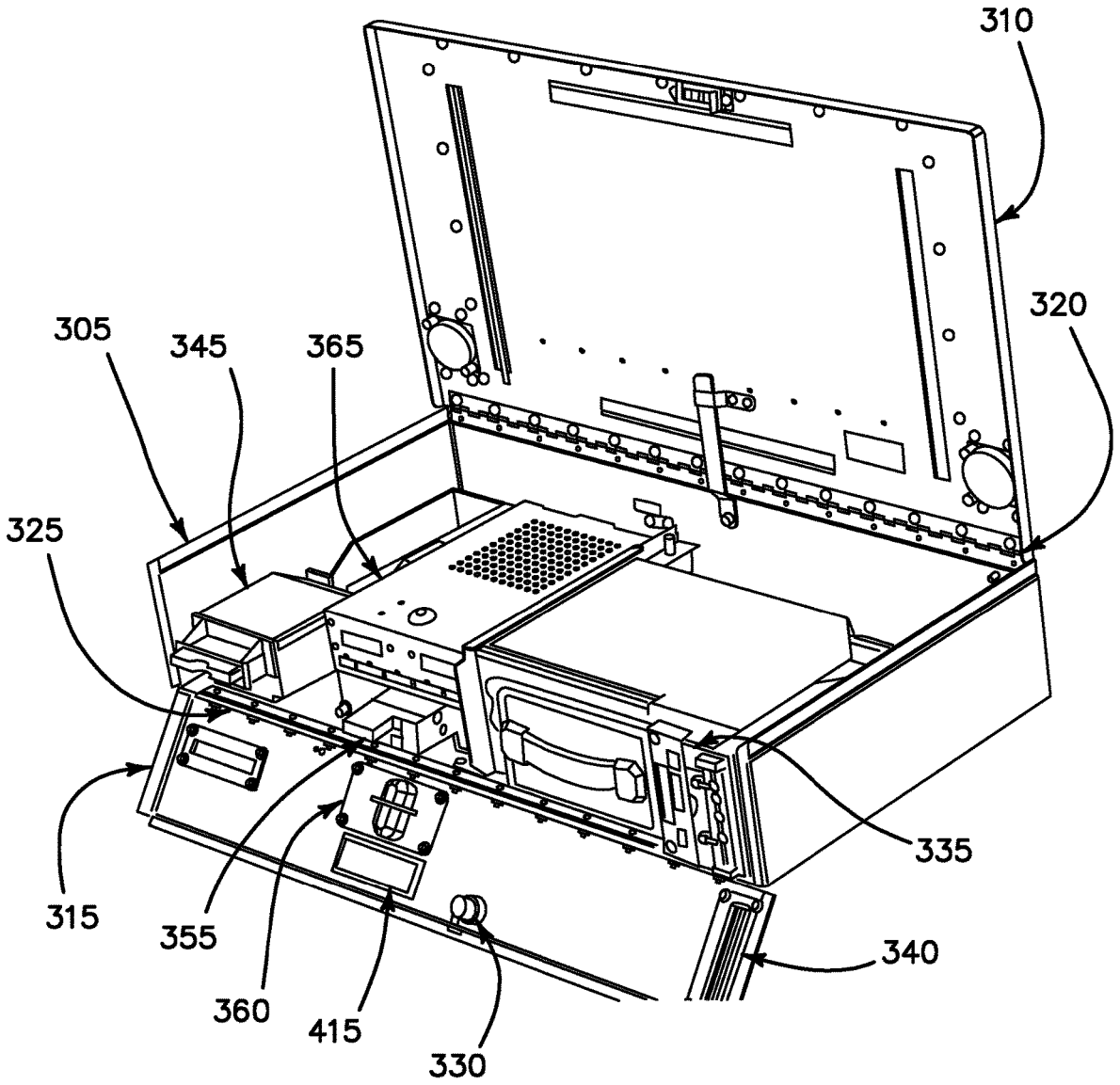
FIG. 4 illustrates a view of the top door and front door in an open position according to the embodiments of the present invention.

FIGS. 3 and 4 show a slot machine cabinet 300 according to the embodiments of the present invention. The slot machine cabinet 300 comprises an enclosure 305 with a top door 310 covering the enclosure 305 from the top and a front door 315 covering the enclosure 305 from the front. The top door 310 is attached to the enclosure 305 with a top hinge 320 and the front door 315 is attached to the enclosure 305 with a bottom hinge 325. The front door 315 is lockable to the top door 310 using a lock 330 mounted to the front door 315.

FIG. 4 shows that the enclosure 305 houses a horizontally-mounted bill validator 335 having a vertical bill/ticket insertion tip 340 aligned with the bill validator 335 and attached directly to the front door 315. The enclosure 305 also incorporates a ticket printer 345 having a ticket dispenser tip 350 aligned with the ticket printer 345 and attached directly to the front door 315. The enclosure 305 also houses a magnetic card reader 355 having a card insertion slot 360 aligned with the magnetic card reader 355 and attached directly to the front door 315.

The enclosure 305 also houses a lockable computer compartment 365. The computer compartment 365 houses a PC-compatible computer controlling operations of the slot machine housed in the cabinet 300 (not shown). The computer interfaces with all other peripherals of the slot machine housed in cabinet 300, specifically including, but not limited to, the bill validator 335, ticket printer 345 and card reader 355, via a wire harness (not shown).

The top door 310 houses a touch screen LCD touchscreen monitor 370 attached to the exterior of the top door 310 (as taught in co-pending patent application Ser. No. 14/191,406, now abandoned) using a mounting frame 375. In addition, the top door 310 incorporates left and right ventilation grill 380, 385, respectively.

Figure 5:
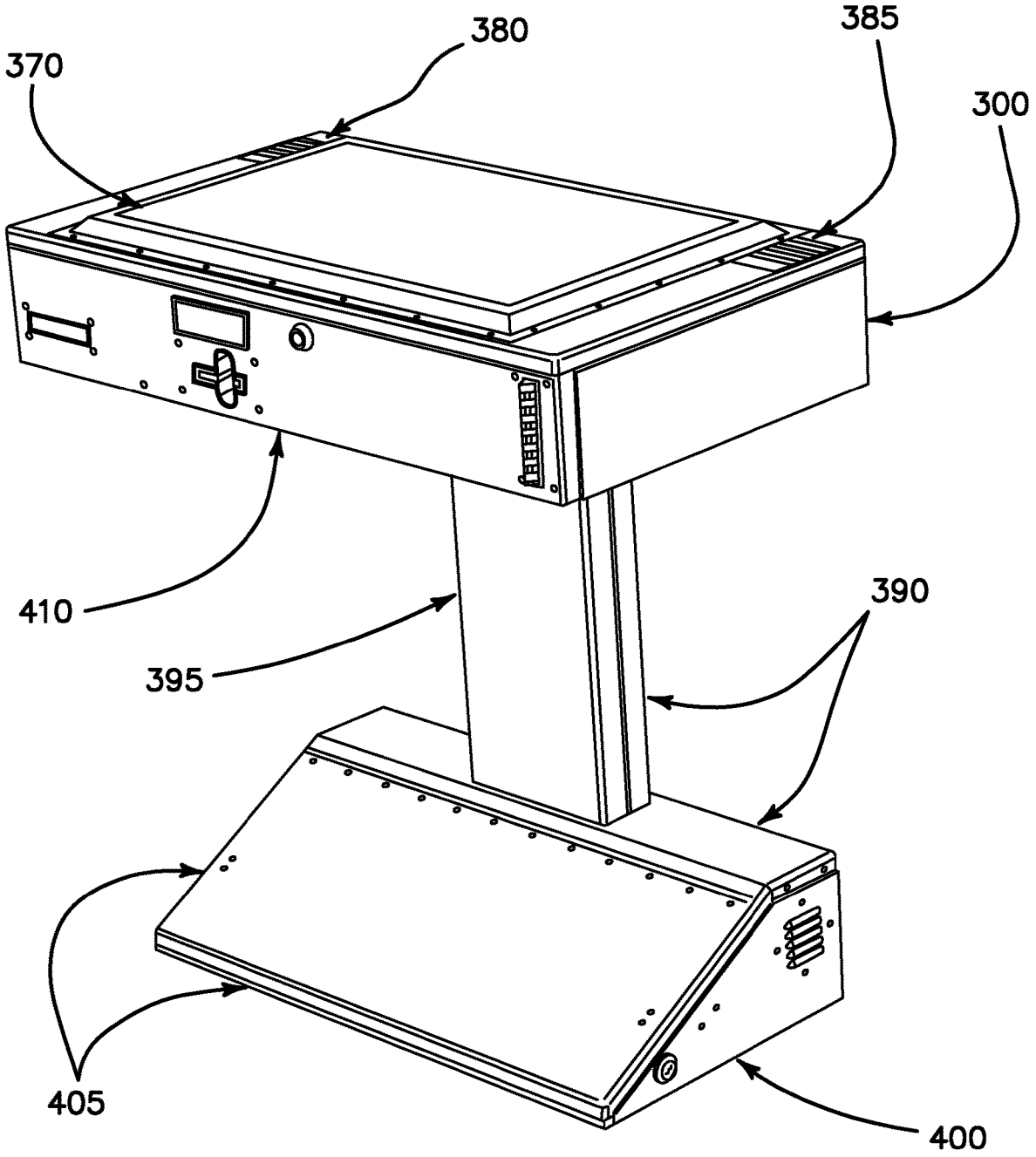
FIG. 5 illustrates a slot machine support structure according to the embodiments of the present invention.

In one embodiment, cabinet 300 is mounted on a hollow vertical support structure 390 as shown in FIG. 5. The support structure 390 not only supports the cabinet 300 but also provides a conduit for running power and communications cables to interconnect the computer compartment 365 with respective power and communications outlets built into a floor on which a support column 395 stands. Optionally, the support structure 390 may incorporate a foot rest 400 having a hinged top door 405 providing service access to the power and communication outlets.

In combination, the cabinet 300 and the support structure 390 provide significant legroom 410 under the cabinet 300 for the player as illustrated in FIG. 5. Such legroom 410 allows a player to position a slot chair close to the support structure 390 saving floor space for the casino. Also, significant legroom 410 facilitates prolonged play by players.

The embodiments of the present invention may be implemented in many specific configurations without departing from the scope and spirit of the present invention. For example, the front door 315 can be equipped with an additional small player tracking LCD 415. Also, a third LCD monitor can be vertically (or nearly vertically) attached to the cabinet 300 (and/or the support structure 390) to provide additional information to the player.

Figure 6:
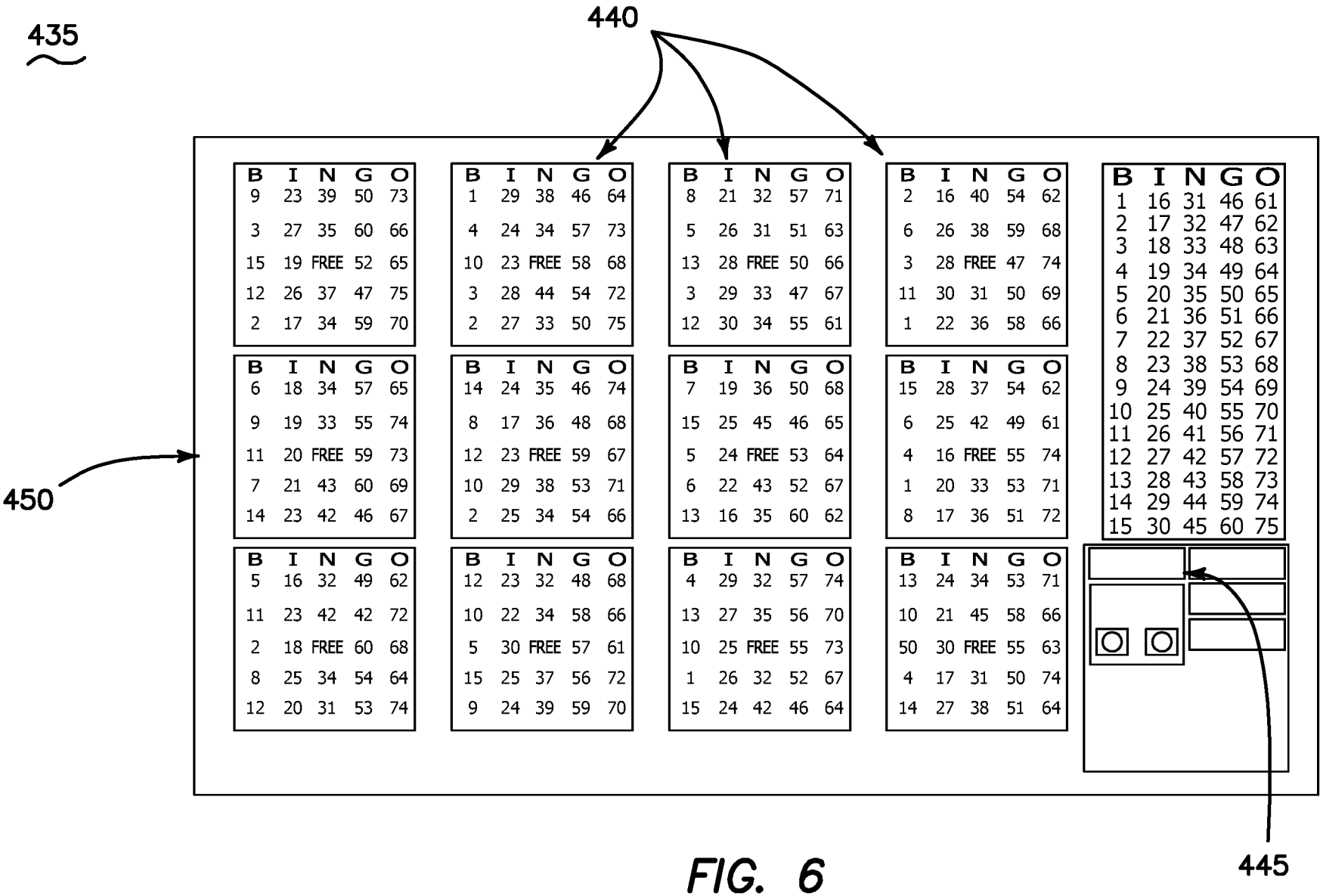
FIG. 6 illustrates a paper bingo pack partially overlaying a touch screen monitor according to the embodiments of the present invention.
Figure 7:
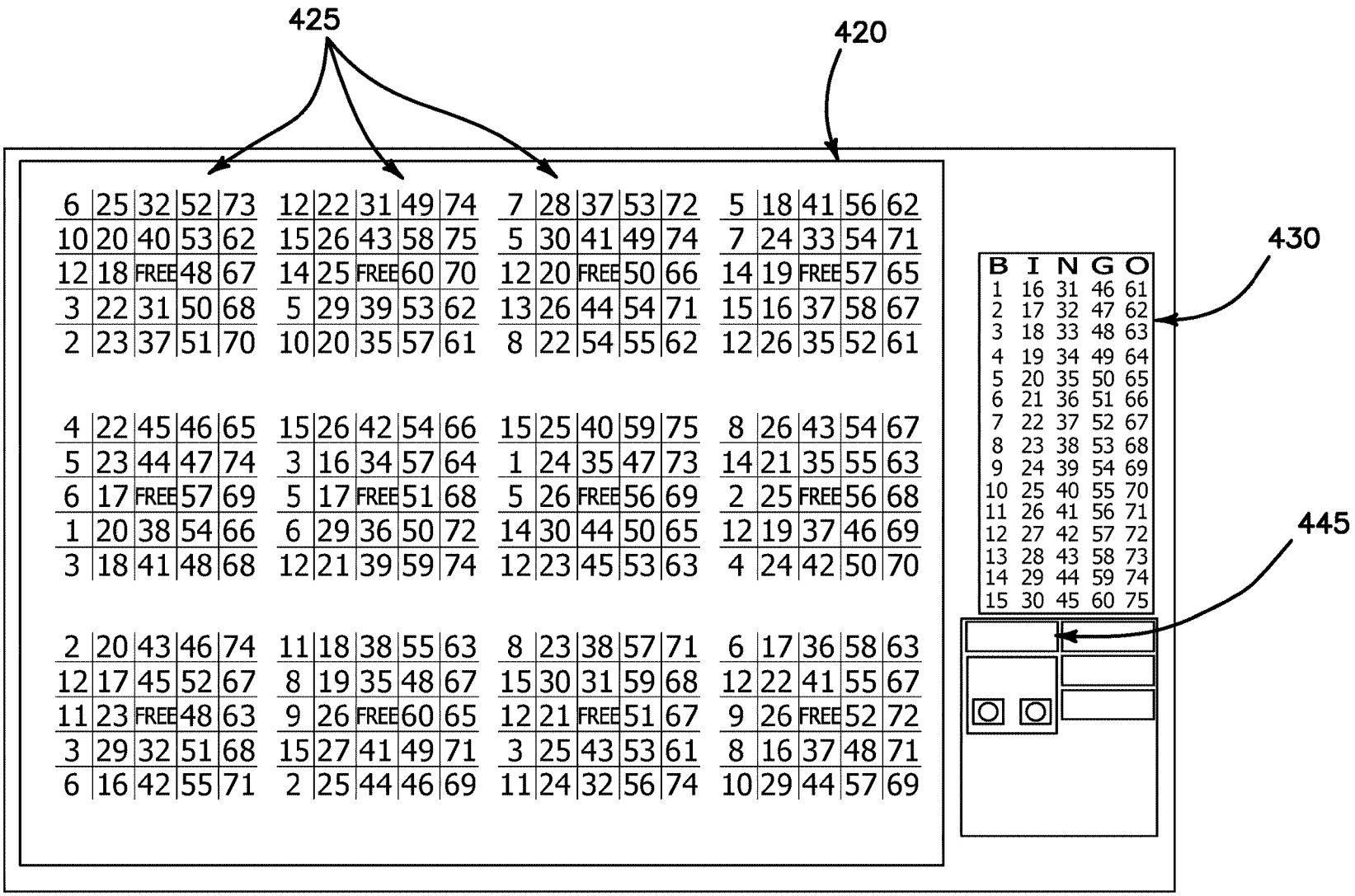
FIG. 7 illustrates a play screen as displayed on the touch screen monitor according to the embodiments of the present invention.

The cabinet 300 may also be equipped with conventional buttons such as "PLAY" and "CASHOUT." In addition, the combination of the cabinet 300 with the support structure 390 facilitates placement of bingo cards on top of the LCD touchscreen monitor 370 allowing bingo players to play their favorite slot and bingo games simultaneously. Specifically, a pack 420 of paper bingo cards 425 can be overlaid on the touchscreen 370 as shown in FIG. 7. Pack 420 covers most of the touchscreen monitor 370 and only a portion 430 of the touchscreen monitor 370 is exposed to external view. Yet, the portion 430 displays sufficient game status information for the player to ascertain the current status of the game as taught, for example, in U.S. Pat. Nos. 8,568,224, 8,469,790, 7,611,407 and 4,856,787 each to Itkis, et al., each incorporated herein in their entirety by reference. For comparison, FIG. 6 shows the complete player screen 435 which explicitly displays electronic bingo cards 440 monitored by the computer mounted inside of the computer compartment 365.

Generally, overlaying the touchscreen monitor 370 with paper bingo pack 420 may create false screen touch signals when the player "daubs" the paper cards 425 with a "dauber." To eliminate such false screen touch signals, options button 445 provides means for disabling the touch signals before overlaying the touchscreen monitor 370 with the paper pack 420. More specifically, in response to pressing the options button 445, the computer contained in the computer compartment 365 displays a menu of available options (not shown) including an option to disable the touch signals in the area 450 covered by the paper pack 425. Once the pack 425 is removed, the player can press the options button 445 again to switch back to the options screen to reactivate the touch signals on the entire touchscreen monitor 370.

Although the invention has been described in detail with reference to several embodiments, additional variations and modifications exist within the scope and spirit of the invention as described and defined in the following claims.

We claim:

1. A gaming device comprising:

an enclosure having a top door and front door;

a lock configured to lock said front door to said top door;

a touchscreen monitor attached to an outside of a top horizontal surface of said top door, said touchscreen monitor positioned horizontally;

a bill validator within said enclosure, said bill validator having a vertically oriented bill insertion tip, said bill insertion tip attached directly to said front door;

a card reader;

a ticket printer; and a processor, in a lockable computer compartment within said enclosure, said processor configured to communicate with, and control, one or more of said touchscreen monitor, ticket printer, card reader and bill validator.

2. The gaming device of claim 1 further comprising a vertical support structure configured to support said enclosure and provide space enough for a chair to slide at least partially below said enclosure.

3. The gaming device of claim 2 wherein said vertical support structure includes a conduit therethrough to accommodate wires and cables.

4. The gaming device of claim 2 wherein said vertical support structure includes a foot rest.

5. The gaming device of claim 1 wherein said touchscreen monitor is configured to accommodate physical bingo cards positioned thereon while providing a touch screen user interface at a location not covered with physical playing cards.

* * * * *